United States Patent [19]

Lauener

[11] Patent Number: 4,798,315

[45] Date of Patent: Jan. 17, 1989

[54] CASTING NOZZLE CONSISTING OF SEVERAL PARTS FOR FEEDING MOLTEN METAL INTO THE MOLD OF A CONTINUOUS CASTING MACHINE

[75] Inventor: Wilhelm F. Lauener, Gerlafingen, Switzerland

[73] Assignee: Larex AG, Recherswil, Switzerland

[21] Appl. No.: 41,468

[22] Filed: Apr. 23, 1987

[30] Foreign Application Priority Data

Apr. 30, 1986 [CH] Switzerland ..... 01787/86
Aug. 25, 1986 [CH] Switzerland ..... 03411/86

[51] Int. Cl.[4] ..... B22D 11/10

[52] U.S. Cl. ..... 222/591; 164/431; 164/432; 164/434; 164/439; 164/440

[58] Field of Search ..... 164/430, 431, 432, 433, 164/434, 429, 437, 438, 439, 440; 222/591, 590

[56] References Cited

U.S. PATENT DOCUMENTS 3,805,877 4/1974 Ward .
4,340,110 7/1982 Honda et al. ..... 164/440 X
4,553,582 11/1985 Artz et al. ..... 164/431 X
4,586,558 5/1986 Mori et al. ..... 164/440

FOREIGN PATENT DOCUMENTS 3328585 7/1984 Fed. Rep. of Germany .
2013855 8/1979 United Kingdom .
2140721 12/1984 United Kingdom .

OTHER PUBLICATIONS

Herrmann, E., *Handbook on Continuous Casting* (German), 1958, p. 60.
Herrmann, E., *Handbook on Continuous Casting*, 1980, pp. 65–77, 82–85. 171–173.

*Primary Examiner*—Nicholas P. Godici
*Assistant Examiner*—J. Reed Batten, Jr.
*Attorney, Agent, or Firm*—Marks Murase & White

[57] ABSTRACT

In a casting nozzle, tubes are placed between a bar-shaped mouthpiece and a distribution bar, which connect holes in the mouthpiece and the distribution bar to allow for the flow of the melt. Pulling rods which are under tension, are anchored to the mouthpiece and to the distribution bar and press these parts elastically against the ends of the tubes in such a manner that the nozzle components are elastically braced, yet remain flexible and can adjust freely to heat dilatations or inaccuracies which occur in fabrication or assembly. The nozzle components, particularly the tubes, are easy to obtain and to exchange. Due to the fact that the pulling rods enter the mouthpiece from its back side and are anchored therein, the mouthpiece can be very slender, thus allowing for thin casting.

15 Claims, 4 Drawing Sheets

1
13
9
9
11
16
12
3
27
26
14a
15
2
14
18
19
17
27
26

1
13
9
9
21
16
3
20
25
24
22
22
23
14a
24
15
2
18
17

CASTING NOZZLE CONSISTING OF SEVERAL PARTS FOR FEEDING MOLTEN METAL INTO THE MOLD OF A CONTINUOUS CASTING MACHINE

BACKGROUND OF THE INVENTION

The invention relates to a casting nozzle which is used to feed molten metal from a tundish into the mold of a continuous casting machine with a travelling mold.

A known casting machine called a caster, contains two metallic belts oppositely positioned which serve as walls of the mold. The belts run over pulleys placed at an entry and an exit side of the mold, which drive, guide and tighten the belts. The belts are intensively cooled externally in order to carry off the heat absorbed from the casting. See E. Herrmann, Handbook on Continuous Casting, pp. 82–85.

Another caster contains two opposite arrangements of metallic blocks which serve as a mold and which circulate in a closed track by means of a drive so that the blocks join tightly over a certain length forming the mold between the two opposite arrangements.

The heat absorbed from the casting is removed by either an internal or an external cooling system. (E. Herrmann, Handbook on Continuous Casting, p. 171–173)

On both casters, the mold is closed on both sides by so-called side dams travelling along with the casting i.e. with the mold walls.

A third caster consists of a so-called casting wheel which has a cavity over its circumference and which is confined by a rim on either side to form three walls of a mold. Accordingly, the cavity corresponds with the cross-section of the casting. The fourth side of the mold consists of a endless metallic belt running tightly over both rims which partly surround the casting wheel. As the casting wheel rotates, the belt moves with it, thus forming a mold travelling along with the casting. See E. Herrmann, Handbook on Continuous Casting, p. 65–77.

On all of these casters, molten metal flows from a tundish by means of a feeding device into the mold. Open as well as closed feeding systems are in use currently, but for high quality casting, a closed feeding system must be used. Molten metal would then be fed from the tundish into the mold by a so-called casting nozzle which extends into the mold, closing the entry side of the mold.

Casting nozzle, hereafter called nozzles, consisting of several assembled parts, are known. Usually such nozzles feature a so-called mouthpiece or tip which is interchangeably mounted at the exit end of the nozzle. See Herrmann, Handbuch des Stranggiessens, p. 60.

It is also known to provide an intermediate part between the mouthpiece and the tundish, with the mouthpiece being connected to the intermediate part by means of a clamping device. See EP-A 0 133 485.

If one considers the width of the casting to be produced, the necessary components for these types of nozzles may have considerable dimensions. Manufacturing costs thus will be very high, requiring expensive investments for their fabrication. While in use, the tundish with the connected nozzle must be precisely positioned in the caster, which is extremely difficult because of the temperatures involved. Such temperatures cause heat dilatations of the support of the tundish, thus requiring complicated and expensive arrangements such as intermediate parts with articulating, spherical joints between tundish and nozzle for compensating unequal dilatations of the different parts. See EP-A 0 133 485.

SUMMARY OF THE INVENTION

The present invention relates to a multisectional casting nozzle having components which are easy to manufacture and which can be replaced individually. Accordingly, operating costs can be reduced, especially when relatively wide strips are to be cast. This benefit is possible because the nozzle is composed of a distribution bar on an entry side and a mouthpiece on an exit side, the distribution bar and the mouthpiece being connected by tubes. The whole nozzle is held together by means of pulling rods which are anchored on one side to the mouthpiece and the other side to the distribution bar by elastic elements. This nozzle has sufficient flexibility to be able to adjust to displacements of the tundish caused by temperature changes and to align itself in the casting mold. Accordingly, the contact between the nozzle mouthpiece and the moving wall of the mold can not cause an undesirable amount of friction. If the strip has a substantial width, the mouthpiece of the nozzle can grow or shrink without restraint because the tubes can follow any displacements on the interfacing surface of the mouthpiece individually. The nozzle according to this invention allows for easy manufacturing of casting nozzles for even the greatest strip widths and practically any length, a benefit which is apparent in machines with a casting mold that lies relatively deep inside the machine.

Also known is a nozzle design in which a connecting piece is placed between the mouthpiece and the tundish, which consists of individual, flat shaped tubes having canals for the accommodation of electric heating elements. See GB-A-1 013 855.

However, in this design, all parts are rigidly connected to each other, manifesting all of the disadvantages which are avoided by the present invention.

Furthermore, a nozzle is known which is divided into various individual tubes. Between neighboring tubes, supporting components are placed which accommodate heating elements. Further details of the design are not provided.

The problem and solution addressed by the present invention do not exist in this nozzle.

Finally, a flat nozzle is known which consists of individual tubes or of a body having various canals whereby the tubes or the body are rigidly connected to a distribution bar, thus forming the actual mouthpiece. See U.S. Pat. No. 3,805,877. Again, this design does not feature a flexible system composed of individual, reciprocally moveable components which are held together by means of pulling rods and elastic elements.

The distribution bar and the mouthpiece have corresponding holes, also called flow through holes, through which the melt flows. Each hole of the distribution bar is connected with the corresponding hole of the mouthpiece by means of a tube. In order to hold the various parts together, transverse holes between the flow through holes are provided to accommodate pins, each pin being limited to at least one pulling rod which is fastened on its other end to the distribution bar by an elastic element. As a result of this configuration, a force acts upon the ends of the tubes thus sealing them off.

Another solution involves providing the pulling rods with heads at the end by which the mouthpiece is pulled towards the tubes, thus providing a tight sealing.

This type of nozzle design is especially well suited for the casting of metals with a high melting temperature such as steel, because it allows the mouthpiece to be composed of various materials.

The holes through which the melt flows can be furnished with protection bushes and the exit side of the nozzle can be covered with a protection bar. In this case, the pulling rods are preferably anchored in the protection bar in order to make it fit tightly to the mouthpiece. Furthermore a heat insulating seal can be placed between the protection bar and the mouthpiece. If required by the manufacturing process or otherwise, the protection bar can be divided into several parts in the direction of the casting width.

A material that can withstand the aggressive influence of the molten metal is employed in the protection bushes in the holes of the distribution bar, in the mouthpiece of the nozzle and in the covering of the exit side thereof. For example, the distribution bar and the mouthpiece can be made from graphite, and bushes made of boron nitride or an other suitable refractory material can be used for the protection of the holes.

Due to the high temperatures, a refractory material can be conveniently employed for the pulling rod which is anchored to the mouthpiece. This rod can be fixed to the metallic component of the pulling rod outside of the mouthpiece by cement or in any other known manner of attachment. For example, a sleeve with an internal thread can be cemented to the ceramic part of the pulling rod and then the metallic part may be screwed into the sleeve.

Preferably, the pulling rod is fastened to a yoke which is placed between neighboring tubes and is pulled or pushed towards the distribution bar on both sides of the tubes. In order to compensate for any slight variations in the tubes, length, an elastic seal of fibrous refractory material can be placed on one or on both ends of the tubes.

It might be convenient to provide two pulling rods per pin, especially when the tubes have a round cross-section.

In the above-mentioned known type of nozzle, the clamping means act upon the outer sides of the mouthpiece thus preventing a slender design of the nozzle. Yet modern tendencies are to cast strips as thin as possible, which is only feasible if the nozzle and particularly the mouthpiece (which practically determine the thickness of the strip) are correspondingly thin. The present invention also relates to the problem of making a particularly slender or thin nozzle with a particularly thin cast strip.

Although it is convenient to place the bracing means, e.g. pulling rods, in between the tubes of the connecting part of the nozzle, the connecting part could also consist of one component in which case the pulling rods could be placed into grooves along the sides thereof.

BRIEF DESCRIPTION OF THE DRAWINGS

The invention and its embodiments can be more specifically described by the following drawings.

DETAILED DESCRIPTION OF THE INVENTION

Figure 1:
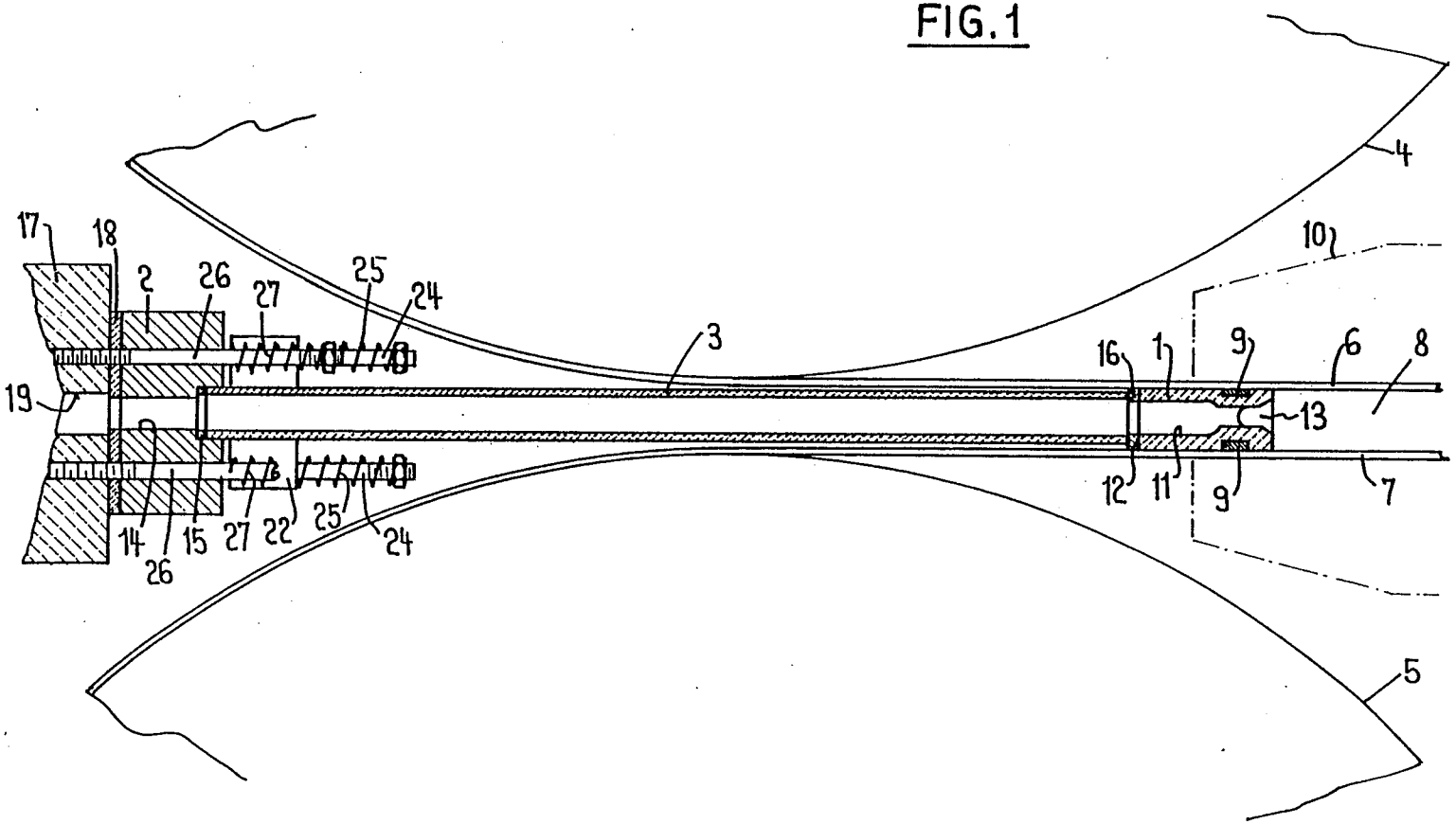
FIG. 1 shows a cross-section of a casting nozzle and the neighboring parts of a continuous casting machine.
Figure 3:
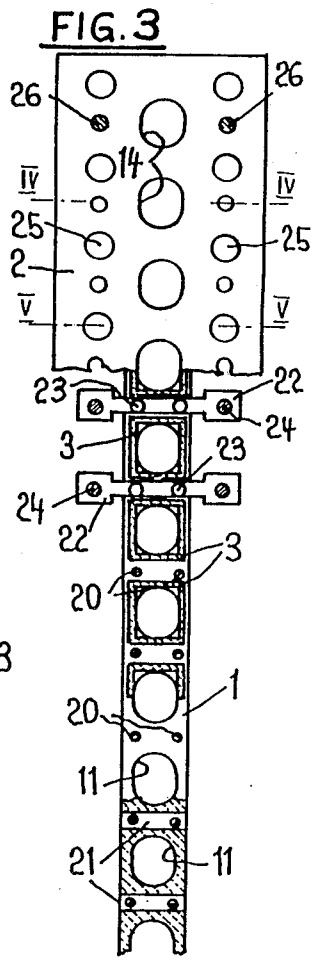
FIG. 3 shows a cross-section along line III/III in FIG. 2.

The casting nozzle shown in FIGS. 1–5 comprises an extended, bar-shaped mouthpiece 1, an extended distribution bar 2 and tubes 3 which are arranged between these two parts. As shown in FIG. 1, the casting nozzle is introduced in between two rolls 4 and 5, as in a twin belt caster.

A casting belt 6 and 7 is led over each of the rolls 4 and 5. These belts are further driven by a similar pair of rolls and run at a speed corresponding to the speed of the casting process. Together with the side dams and the mouthpiece 1, the belts form a casting mold 8 in which the metal fed through the nozzle solidifies and subsequently emerges from in between the belts as a cast strip. Seals 9 prevent the cast metal from leaking out between the mouthpiece 1 and the casting belts 6 and 7. The construction and function of such a caster is generally known and needs no further explanation.

In FIG. 1, housing 10 contains cooling and supporting devices for the casting belts.

The mouthpiece 1 has a row of flow through holes 11 which interface with the tubes 3 on the entry side and connect to a groove 13 on the exit side. This groove preferably spans the whole casting width and is closed on both ends. This configuration provides an even flow and distribution of the melt at the entrance of the mold 8. The distribution piece 2 also has flow through holes 14, whose number and bilateral distance correspond to the holes 11 of the mouthpiece 1. Thus both parts have the same number of holes which are arranged at the same bilateral distances. Each hole 11 is connected to the corresponding coaxially positioned hole 14 by a tube 3 which interconnects with distribution bar 2 in a groove 14*a* where it is sealed by means of an elastic, heat resistant seal 15. Furthermore elastic refractory seals 16 are also put in between the tubes and the interfacing side 12 of the mouthpiece 1. These elastic seals 15 and 16 compensate for slight variations in the tubes' length thereby avoiding very precise measuring and machining procedures. The distribution piece 2 is connected to a tundish connecting piece 17 with an intermediate refractory seal 18. In the tundish connecting piece 17, holes 19 are provided which correspond to and communicate with the respective holes 14.

Parts 1, 2 and 3 of the casting nozzle are linked so that they may move slightly but securely by means of pairs of pulling rods 20 which are placed between neighboring tubes 3.

Figure 5:
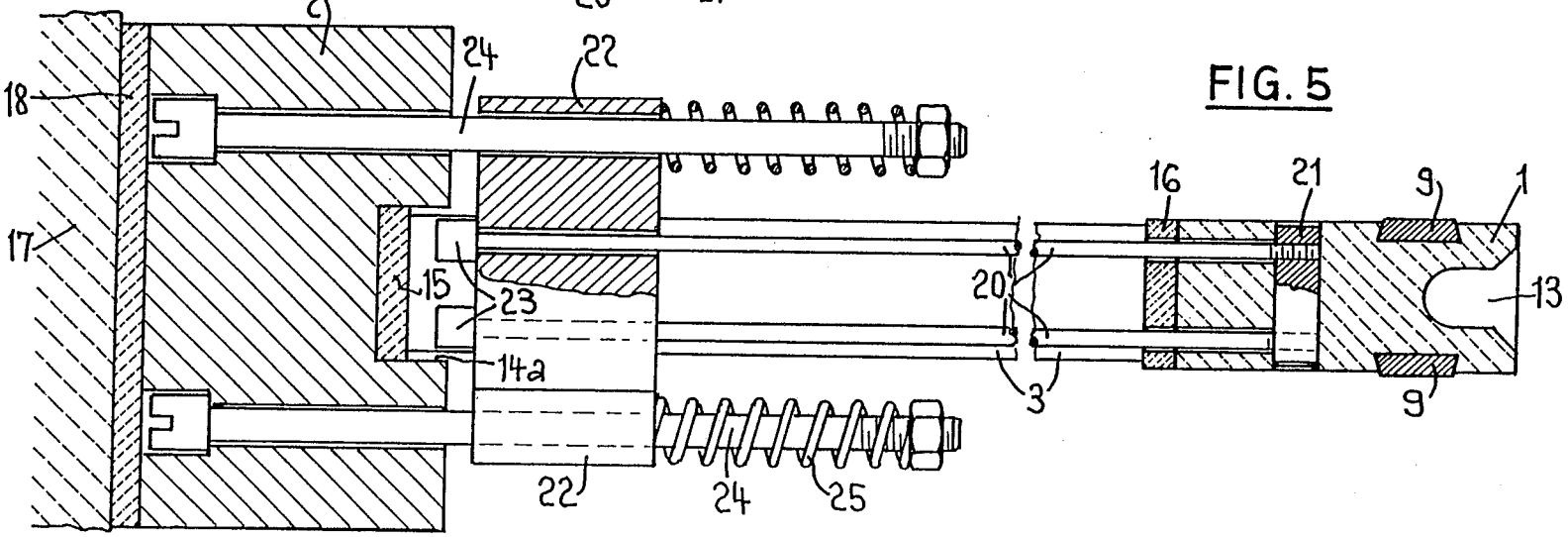
FIG. 5 shows a scaled longitudinal cross-section of a casting nozzle along line V/V in FIG. 3.

In one embodiment, holes are placed transversely in the mouthpiece 1 to accommodate pins 21 into which the ends of the pairs of pulling rods are screwed, as shown in FIG. 5.

Figure 6:
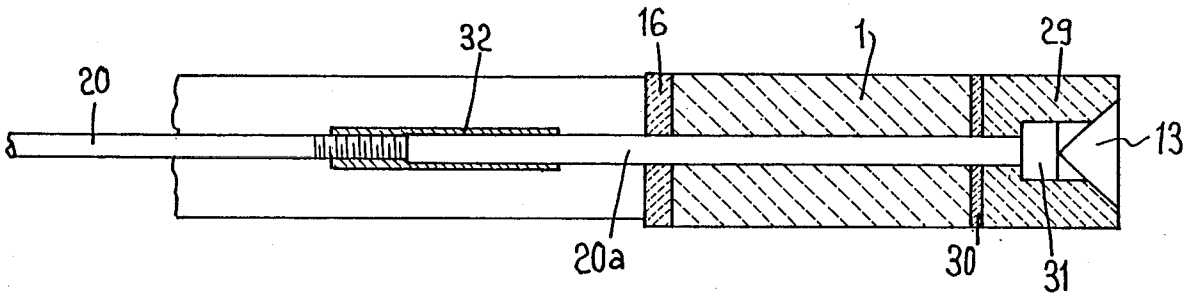
FIG. 6 shows a cross-section of a mouthpiece of another casting nozzle which is composed of various materials and has only one pulling rod between neighboring tubes.
Figure 7:
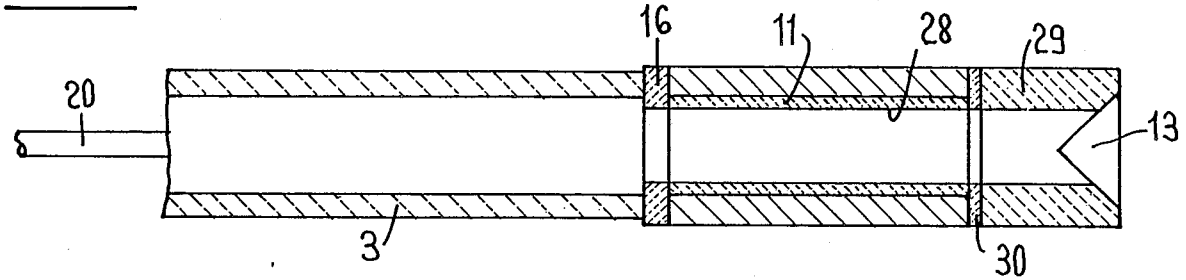
FIG. 7 shows the cross-section of the same mouthpiece together with the tube, the flow through hole and the protection bush therein.

FIG. 6 shows another embodiment which is especially appropriate for casting materials having a high melting temperature such as steel. There, pulling rods 20*a* penetrate the mouthpiece 1 which can be composed of various materials. The pulling rods 20*a* are provided with heads 31 and are anchored to the protection bar 29, thus pressing it against the body of the mouthpiece 1 so that the pulling rods 20a are firmly positioned. Preferably, a refractory, heat insulating seal 30 is placed in between the body 1 of the mouthpiece and the protection bar 29. The holes 11 through which the melt flows can thereby be furnished with protection bushes 28, as shown in FIG. 7.

Preferably, graphite or any other suitable refractory material can be employed for the nozzle body 1. The protection bushes 28 and the protection bar 29 are made from a material that can withstand the aggressive influence of the melt, such as boron nitride or other suitable materials.

Due to the high temperatures within the mouthpiece, it is convenient to use a refractory, ceramic material at least for the part of the pulling rod that traverses the mouthpiece. A material such as aluminum oxyd can be suitably employed. This part can be connected to the metallic part 20 of the pulling rod in a known manner, e.g. a metallic sleeve 32 with an internal thread can be cemented onto the ceramic part 20a and the metallic part 20 can then be screwed into the sleeve. The other ends of the pulling rods 20 traverse holes in corresponding yokes 22 and are anchored thereto by means of heads 23. Each yoke for its part is anchored to the distribution bar 2 by means of two bolts 24 and two compression springs 25. The compression springs press the mouthpiece 1 and the distribution bar 2 elastically against the ends of the tubes 3 thereby holding the corresponding parts securely in place yet allowing for small displacement perpendicular to the direction of the tension thus rendering possible a self-alignment of the parts. A certain self-adjustment of the parts also occurs in the direction of tension, i.e. the longitudinal direction as a result of the seals' 15, 16 and 18 elasticity.

The tension of the pulling rods can be produced by various arrangements of the springs. Instead of employing pulling rods 24 and compression springs 25 for example, one could also use tension springs that act on the distribution bar 2 and the yokes 22, thus requiring the distance between the yokes 22 and the distribution bar 2 to be greater than in an arrangement with compression springs 25.

The means for connecting such springs to the yokes 22 or to the distribution bar 2 can be adjusted in the longitudinal direction, thus allowing for preselection of the spring tension.

As a further possibility, the required tension could be produced by means of pneumatically or hydraulically operated elements.

Figure 4:
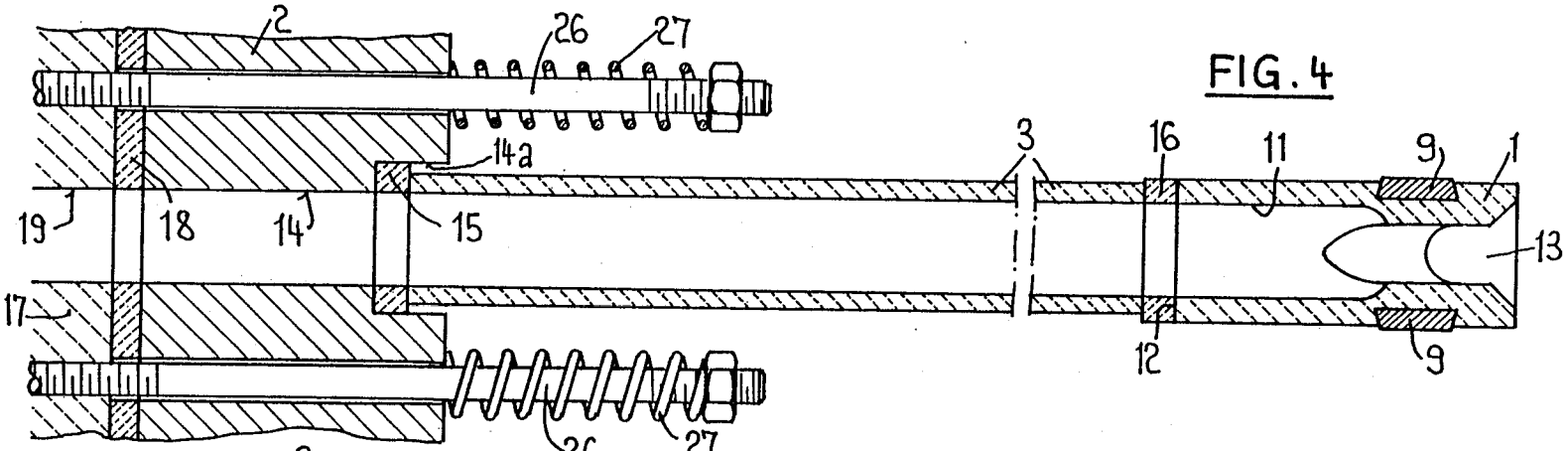
FIG. 4 shows a scaled cross-section along line IV/IV in FIG. 3.

The distribution bar 2 and the complete nozzle are also connected elastically to the tundish by pulling rods 26 which support compression springs 27 bolted to connecting piece 17 of the tundish. The springs 27 act upon the distribution bar 2 thus pressing it against connecting piece 17. Although FIG. 2 shows only one pulling rod 26 with a spring 27, pairs of pulling rods 26 and springs 27 are placed in between all neighboring tubes, as shown in FIG. 4.

Figure 2:
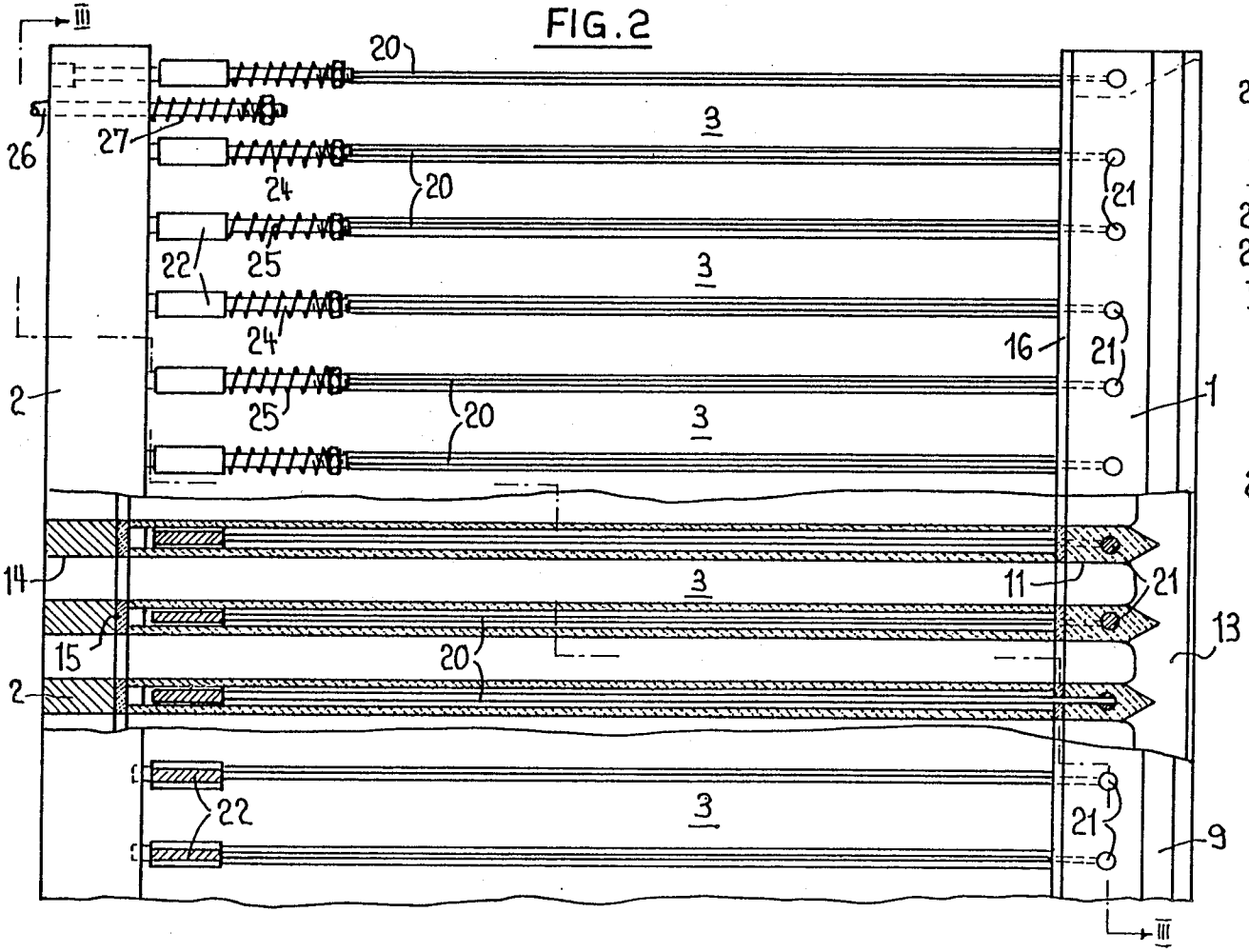
FIG. 2 shows a side view consisting of a cross-section of the casting nozzle.

As also shown in FIG. 2, the tubes lie as close as possible to each other yet in a manner so as to leave sufficient distance for the accommodation of the pulling rods 20 and the yokes 22. A type of nozzle for casting aluminum strips with a thickness of 20 mm has the following characteristics: The nozzle mouthpiece 1 consists of a refractory that can not be wetted by aluminum. The rectangular tubes 3 with an inside clearance of 21×12 mm and a wall thickness of 3 mm consist of aluminum titanate. Cast iron is used for the distribution bar 2 and flow through holes 14 are furnished with refractory bushes. Due to the increase in temperature of the pulling rods 20, 24, and 26, as well as the pins 21, a heat resistant material is employed for these parts. The pulling rods 20 have a diameter of 3 mm, and the pulling rods 24 and 26 have a diameter of 6 mm. The preload of the springs 25 is 120 N each, and the preload of the springs 27 is 200 N each. The length of the mouthpiece 1 is 55 mm, the length of the tubes 3 is 500 mm and the thickness of the distribution bar is 30 mm. The total length of the nozzle therefore is 585 mm. Other materials, dimensions and pretention forces can be applied if required. All metal parts can be used indefinitely as they are not subject to any wear. The tubes 3 are available on the market in any of the required dimensions and, if treated with care, can be used repeatedly over long periods of time. If required, the tubes can be replaced individually. The complete unit can be attached to or detached from the tundish by known fastening methods such as quick couplings. Therefore the nozzle in the caster can be changed very quickly.

The nozzle of the present invention not only offers the obvious economical benefits over known nozzles, it also features substantial operational advantages.

I claim:

1. A casting nozzle for introducing molten metal into a mold of a continuous casting machine, comprising a mouthpiece, a tundish and a connecting part comprising tubes, the connecting part being positioned between the mouthpiece and the tundish, the mouthpiece and the connecting part being held together by pulling rods under a tension caused by elastic elements.

2. A casting nozzle according to claim 1, wherein a distribution bar is positioned between the tundish and the connecting part, the distribution bar and the mouthpiece both having flow-through holes corresponding to each other and distributed over the casting nozzle, each hole of the distribution bar being connected with the corresponding hole of the mouthpiece by a tube, the mouthpiece having transverse holes between the flow-through holes wherein pins are inserted in such transverse holes, each pin having at least one pulling rod anchored thereto, each pulling rod also being connected to the distribution bar by an elastic element, thus forcing a tight seal upon the ends of each tube.

3. A casting nozzle according to claim 1, wherein a distribution bar is positioned between the tundish and the connecting part, the distribution bar and the mouthpiece both having flow-through holes corresponding to each other and distributed over the casting nozzle, each hole of the distribution bar being connected with the corresponding hole of the mouthpiece, at least one pulling rod positioned between the holes being anchored to the mouthpiece by a head and the mouthpiece, actuated by an intermediate elastic element, being connected to the distribution bar, thus forcing a tight seal upon the ends of each tube.

4. A casting nozzle according to claim 1, wherein more than one hole exists between the pulling rods.

5. A casting nozzle according to claim 1, wherein each pulling rod is connected to a yoke positioned between two neighboring tubes near the distribution bar, the yoke, actuated by flexible elements, being connected to the distribution bar.

6. A casting nozzle according to claim 1, wherein metallic or ceramic springs a force that acts upon the tubes.

7. A casting nozzle according to claim 1, wherein two pulling rods are arranged with each pin.

8. A casting nozzle according to claim 1 or 2, wherein flexible seals are positioned between the tubes and the contact surfaces of the mouthpiece and of the distribution bar.

9. A casting nozzle according to claim 2, wherein the mouthpiece has a groove along the casting nozzle which connects with the holes, thereby achieving an even flow of the melt into the casting mold.

10. A casting nozzle according to claim 1, wherein the mouthpiece includes holes containing bushes, the mouthpiece being covered on one side by a protection bar, the bushes and protection bar consisting of material which is resistant to the melt.

11. A casting nozzle according to claim 10, wherein the mouthpiece consists of graphite and the bushes and the protection bar consist of boron nitride.

12. A casting nozzle according to claim 11, wherein the protection bar is divided into several parts along the casting nozzle.

13. A casting nozzle according to claim 10, wherein a seal is positioned between the mouthpiece and the protection bar to serve simultaneously as a heat insulator.

14. A casting nozzle according to claim 1, wherein the pulling rods anchored to the mouthpiece consist of a refractory material.

15. A casting nozzle for the introduction of molten metal into the mold of a continuous casting machine, comprising a mouthpiece, a distribution bar and connecting part positioned between the mouthpiece and the distribution bar whereby the mouthpiece, the distribution bar and the connecting part are held together by pulling rods which enter the mouthpiece on one side of the mouthpiece and are anchored to the mouthpiece.

* * * * *